United States Patent [19]

Richter

[11] Patent Number: 4,497,096

[45] Date of Patent: Feb. 5, 1985

[54] TENTER FRAME DRIVE AND METHOD

[75] Inventor: Hans H. Richter, Warwick, R.I.

[73] Assignee: Marshall and Williams Company, Greenville, S.C.

[21] Appl. No.: 319,703

[22] Filed: Nov. 9, 1981

[51] Int. Cl.[3] ..... D06C 3/04

[52] U.S. Cl. ..... 26/74; 26/89; 26/91

[58] Field of Search ..... 26/74, 89, 91; 198/854, 198/855

[56] References Cited

U.S. PATENT DOCUMENTS

| | | | |
|---|---|---|---|
| 2,393,563 | 1/1946 | Petterson | 198/854 X |
| 2,673,384 | 3/1954 | Roberts | 26/91 X |
| 3,727,273 | 4/1973 | Hyatt et al. | 26/91 |
| 3,755,862 | 9/1973 | Molz | 26/89 X |

FOREIGN PATENT DOCUMENTS

| | | | |
|---|---|---|---|
| 2019938 | 11/1971 | Fed. Rep. of Germany | 26/89 |
| 56-43115 | 4/1981 | Japan | 198/855 |
| 517996 | 2/1940 | United Kingdom | 26/89 |

*Primary Examiner*—Robert R. Mackey

*Attorney, Agent, or Firm*—Bailey & Hardaway

[57] ABSTRACT

A tenter frame drive is illustrated wherein auxiliary power operated means are provided to drive the sprockets at the entrance end of the chain runs, opposite the main drive at the exit end. The auxiliary drives remove the slack in the chains which normally occurs at the exit end opposite the point of driving engagement of the sprockets in such a fashion as to avoid chattering of the chain and tenter clips while providing for a division of the forces so as to some extent reduce the maximum tension in the chain, and at the same time insure sufficient tension for proper gripping of the web at the entrance end of the tenter.

2 Claims, 8 Drawing Figures

Fig. 2-A.

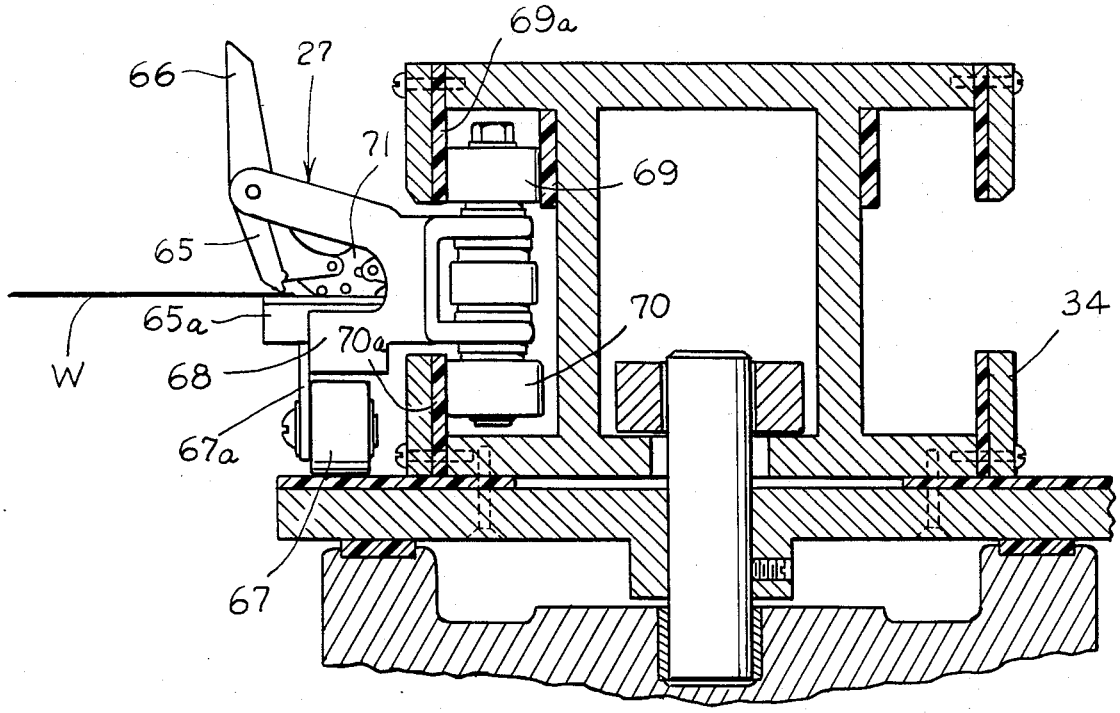
Fig. 6.
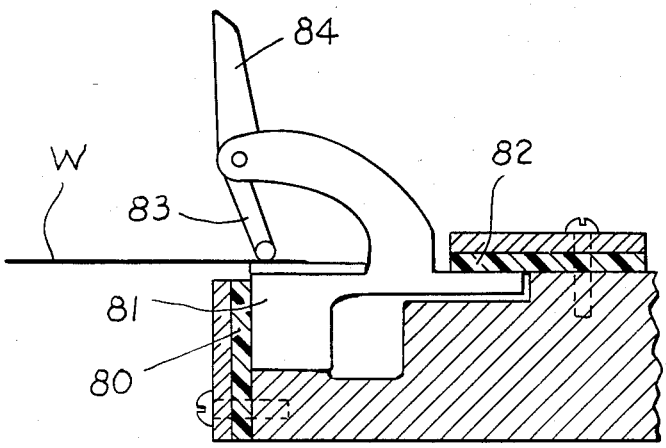
Fig. 6-A.

TENTER FRAME DRIVE AND METHOD

BACKGROUND OF THE INVENTION

It is desirable in tenter frames to have a driven sprocket for each of the opposed runs of chain. Thus, a main drive at the exit or delivery end of the tenter frame may be provided in such a way that a single motor drives both chain sprockets through a splined or other positive mechanical connection to insure maintaining the opposed tenter clips in proper register. In other words, the travel of the opposed runs of chain must be coordinated so that one does not advance with respect to the other during the web carrying process. Because of the splined connection, some adjustment in transverse spacing between the chains is permitted at the delivery end of the tenter frame. It is also important that the drive for the tenter frame be controlled at a single end, otherwise a control at the other end may take over and have a tendency to cause undesirable variations in speed and control of the tenter frame.

A problem in controlling the slack in tenter chains, which have heretofore usually had a spring loaded sliding mounting and the like on the rails, has persisted although the problem has been addressed in a number of ways in an effort to find a solution. Tenter frames presenly in service utilize substantially zero or minimal tension at this point. Efforts to increase the tension in the chain to avoid chattering or excessive tangential movement necessarily have the undesirable affect of increasing the tension on opposed portions of the chain causing excessive wear and maintenance on the various moving and auxiliary parts of the tenter frame.

With the advent of roller clips and the desirability of using chains of greater length accompanied often by higher speeds for carrying the clips, the problem of chattering of the chains and tenter clips opposite the drive points at the delivery end of the tenter has become aggravated. One of the major advantages of utilizing roller clips is the possibility of running the chains and clips on the rails without grease or oil, deriving many advantages therefrom, however, the impact upon the roller bearings, accompanied by the chattering action of the chain when driven near zero or at low tension with the tendency for tangential movement of the tenter clips results in impact loads which are especially harmful to bearings, causing excessive wear and roughness of operation.

It is particularly desirable to employ the drive means illustrated herein in connection with roller mounted clips and rails which have suitable connection for avoiding uneven movement of the tenter clips as disclosed in co-pending application Ser. No. 196,257, filed Oct. 14, 1980, in the name of Hans H. Richter for TENTER FRAME WITH ROLLER CLIP.

Such roller bearing clip mechanisms are especially desirable for use in film and textile tenters with which the invention hereof is described, however, the apparatus and method hereof has application to tenter frame mechanisms generally including the standard sliding variety of tenter clip devices.

This application is an improvement upon the aforesaid application, Ser. No. 196,257, filed Oct. 14, 1980, and the disclosure thereof is incorporated and made a part hereof by reference.

Accordingly, it is an important object of this invention to provide an auxiliary drive associated with each of the sprockets carried at the entrance ends of each of the chains of a tenter frame to remove slack and avoid chattering in the chains of the tenter frame.

Another important object of the invention is to provide an auxiliary drive system at the entrance end of a tenter frame in such a way that the auxiliary drive is controlled responsive to the main drive at the delivery end of the tenter frame.

Still another important object of the invention is to provide an auxiliary drive mechanism for removing the slack in the tenter clip carrying chains of a tenter frame in such a fashion as to reduce the tension occurring at the point of maximum tension in the chains while assuring sufficient tension at the pull side runs that effectively control the web at the entrance portion of the tenter frame.

SUMMARY OF THE INVENTION

It has been found that the slack which has been inherent in tenter frames being prevalent at the points of minimum tension opposite the drive at the delivery end of the tenter frames may be reduced while the tension at points of high tension in the chain may be diminished through the provision of auxiliary drives for the respective sprockets at the entrance ends of the chains in such a fashion that the auxiliary drives are controlled responsive to conditions prevailing at the main drive end of the tenter frame. It is important that the auxiliary drives be normally incapable of driving the tenter frame without the main drive, as such would tend to vary speed and control conditions of the tenter frame. It is desirable therefore, that the auxiliary drives be of insufficient power to power the tenter chains by themselves and that they apply less force on the chains than the main drive. A control mechanism has been provided wherein the auxiliary drives are controlled responsive to conditions prevalent at the delivery end of the tenter frame in such a fashion that an electrical signal is given to the auxiliary drive. Control in this fashion provides torque proportional to speed.

If desired, the auxiliary drive may exert variable a controlled tension upon the return side of the chain or the tension may be controlled by a motor delivering maximum torque, but the torque thus delivered should be less than that imparted to the respective chains by the main drive. The auxiliary device should deliver enough torque to drive the return side with sufficient tension at its delivery point to distribute sufficient tension in the return side of the chain to tension the point of the chain opposite the point at which the chain is driven by the main drive. In other words, the torque at the auxiliary end must be lower than that delivered at the drive end but must exert enough tension on all parts of the return run up to the main drive to positively position the chain against irregular movement and to avoid chattering, while reducing the bow in the chain which occurs when the tenter is driven at high speeds.

The drive motors, which include preferably a separate motor for each chain, may be either in the form of an electrical motor, preferably a D.C. motor, or a fluid motor, preferably of the hydraulic type, provided with suitable controls.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein examples of the invention are shown and wherein:

FIG. 2-A is a schematic plan view illustrating a modified form of the invention wherein a fluid motor is utilized in the drive illustrated in the upper left-hand portion of FIG. 2.

FIG. 6 is a transverse sectional elevation across a rail and chain of the tenter illustrating a roller bearing tenter clip carrying a web, and FIG. 6-A is a transverse sectional elevation similar to FIG. 6, illustrating a sliding tenter clip carried on the usual rail with auxiliary positioning means.

DESCRIPTION OF PREFERRED EMBODIMENTS

The drawings illustrate a tenter frame having a pair of clip carrying chains with adjacent pull side runs and remote return side runs, a sprocket at each end of each chain and a rail supporting said clips. A drive constructed in accordance with the present invention, illustrated in FIGS. 2–5, includes a power operated means A including a mechanical drive connection at a delivery end between adjacent chain driving sprockets. A separate drive means B is provided for each sprocket at an entrance end of the tenter chains. Means C is provided for controlling the separate drive means to exert tension sufficient to substantially remove slack in the return side runs while permitting sufficient tension in the pull side runs of the chains. An over-riding clutch or drive means D is provided to guard against damage resulting from a failure in the drive system as, for example, electrical motor burn out, a timing belt break or other failures in the drive mechanism. Thus, the sprocket will turn as an idler as in conventional tenter frames. Therefore, no additional torque will be applied to the chain.

Figure 1:
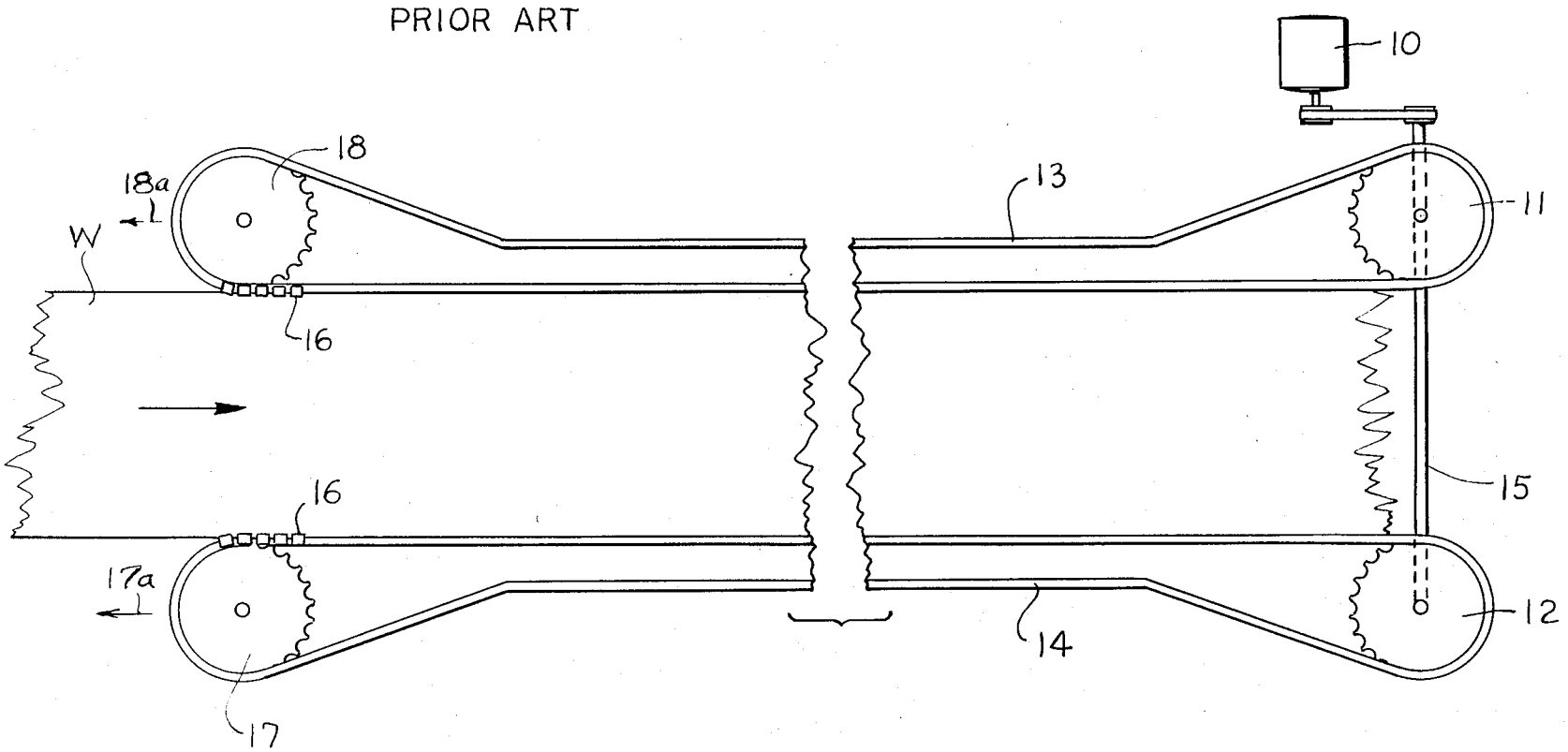
FIG. 1 is a schematic plan view illustrating a tenter frame having a drive constructed in accordance with the prior art.

Referring now to FIG. 1, which illustrates the prior art, it will be observed that a drive motor 10 at the exit end of the tenter frame drives the respective sprockets 11 and 12 to drive the chains 13 and 14 along the rails provided therefor. The sprockets 11 and 12 are driven through a mechanical connection schematically illustrated at 15. The web W may, for example, be fabric, film or other sheet material depending upon the type of tenter being utilized. The opposed tenter clips are illustrated at 16 adjacet the entrance end, although they are positioned all along the respective chains.

A study of prior art tenter frames reveals that maximum high tension occurs at the drive points of the sprockets at the delivery end of the chains. These drive points are on inner, opposite points of engagement of the adjacent pull side runs of the chains. The lowest tensions in the respective chains occur on the opposite sides of the sprockets at the delivery end at the outside or return runs of the chains where the tendency is for the tension to approach zero and for the chattering occurring due to the tangential component of force exerted on the empty tenter clips as they pass round the sprocket to be most pronounced. The chattering and resulting impact loads exerted upon the chains and tenter clips and associated parts become more pronounced the higher the speed at which the tenter is operating.

At the sprockets adjacent the entrance end of the tenter frame, these respective sprockets being designated at 17 and 18 in FIG. 1, there tends to be a low tension at the pull side runs which is even lower than the tension in the chain on the opposite sides of these respective sprockets. Efforts to reduce chattering in the past have included tensioning the idler sprocket to compensate for tenter chain expansion and to apply a pretension on both chain runs. In order to be effective in avoiding chattering, excessively high tensions were necessitated. Such tensions are applied to the sprockets 17 and 18 in the direction of the arrows 17*a* and 18*a* in FIG. 1, as by springs or hydraulic cylinders and the like. The tension and attendant wear is at its greatest at the drive points at the delivery end of adjacent chain runs.

Figure 2:
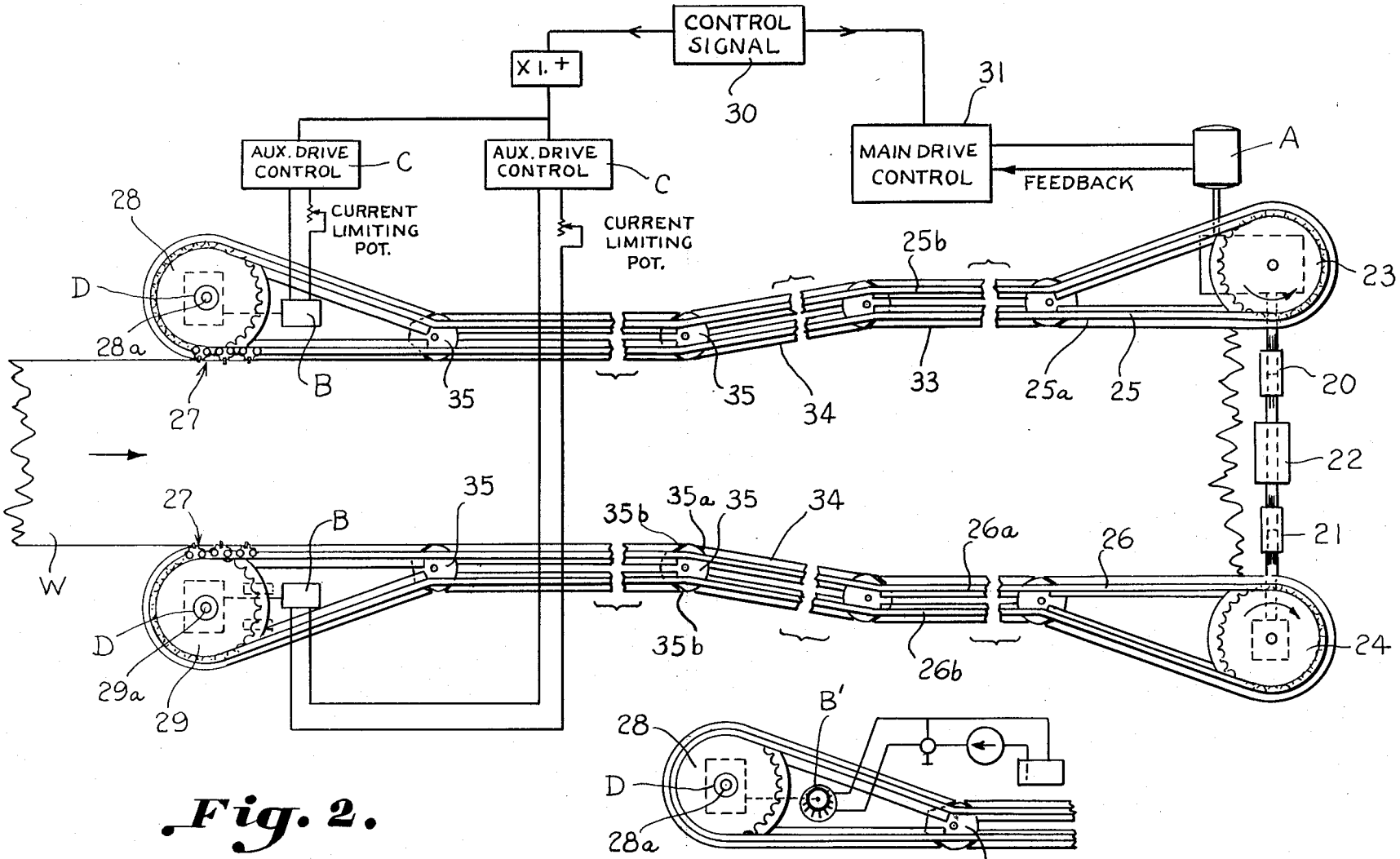
FIG. 2 is a schematic plan view illustrating a tenter frame which may be a film or textile tenter which is powered with an auxiliary drive mechanism with controls constructed in accordance with the present invention.

Referring now particularly to FIG. 2, a schematic diagram of the drive arrangement and method hereof is illustrated in connection with a film tenter wherein the film web is designated at W. The main drive motor A is illustrated as driving a mechanical connection, including a series of splined shafts having corresponding internally splined couplings 20 and 21 with a central bearing 22 being provided. As previously mentioned, the splined arrangements are provided in the event it becomes necessary to adjust the distance between the tenter chains at the delivery end. The sprockets at the delivery end are illustrated at 23 and 24 and are driven respectively in the direction of the arrows in FIG. 2. The respective chains are illustrated at 25 and 26 having pull runs 25*a* and 26*a* adjacent each other with remote return runs 25*b* and 26*b*. Opposed tenter clips are broadly designated at 27 carried by respective chains being illustrated adjacent the entrance end of the tenter frame but being otherwise omitted for clarity.

Auxiliary drive motors B are illustrated in FIG. 2 for driving respective sprockets 28 and 29 carried at the entrance end of the tenter frame upon respective vertical shafts 28*a* and 29*a*. The over-running clutches D are illustrated as carried by the respective shafts 28*a* and 29*a*, and will be described in greater detail below.

The control mechanism for the apparatus and method hereof is illustrated in FIG. 2 and includes a suitable control signal generator 30. A control signal is applied therefrom to the main drive control 31 which controls the speed of the motor A. A feedback signal is applied as illustrated, to the main drive control.

The control signal generator 30 applies a signal indicating a speed of somewhat over that applied to control the motor A, and is illustrated as 1.+ in the schematic control diagram of FIG. 2. Such signal is applied to the respective auxiliary drive controls C and the respective auxiliary drive motors B. The control mechanism, which is schematically illustrated, includes current limiting potentiometers as illustrated for each auxiliary drive control C for each respective motor B, and such current limiting mechanism does not permit the motor B to achieve the speed called for by the signal from the control signal generator 30. This arrangement permits a tension to be imparted to the chain at the entrance end of the tenter frame at adjacent drive points opposite adjacent pull runs of the chain. This permits the tensioning of the chain so as to avoid chattering, wear and vibration at the remote side of the sprockets at the delivery end of the tenter frame. The foregoing are illustrated as D.C. drives.

As illustrated in FIG. 2-A, a fluid motor B, and controls may be substituted for the D.C. motor B with current limiting controls. If desired, the motor B could be operated at maximum torque at all times but it is desirable that the motor be of limited capacity so that torque delivered thereby be less than the torque delivered to the chain at the drive end during operation.

As previously stated, it is very important that this be accomplished in such a way that the applied tension will never exceed the tension needed to stretch and support the web, whether fabric or film, on the driving runs of the chain. It is especially important that the tension be sufficient at the runs of the entrance end to sufficiently control the web as it enters the tenter and supplies sufficent tension all along the adjacent pull runs of the tenter frame. By thus somewhat dividing the tension by the supplemental drive, the maximum tension normally imparted to the chains at the delivery end may be substantially reduced to cut down on the wear occasioned by exerting the maximum tension between the respective sprockets and chains.

The rail mechanisms are schematically illustrated in FIG. 2 wherein the respective rails 33 and 34 which carry the respective chains and position the tenter clips for guided movement therealong, include junctions with a next abutting rail section.

Figure 3:
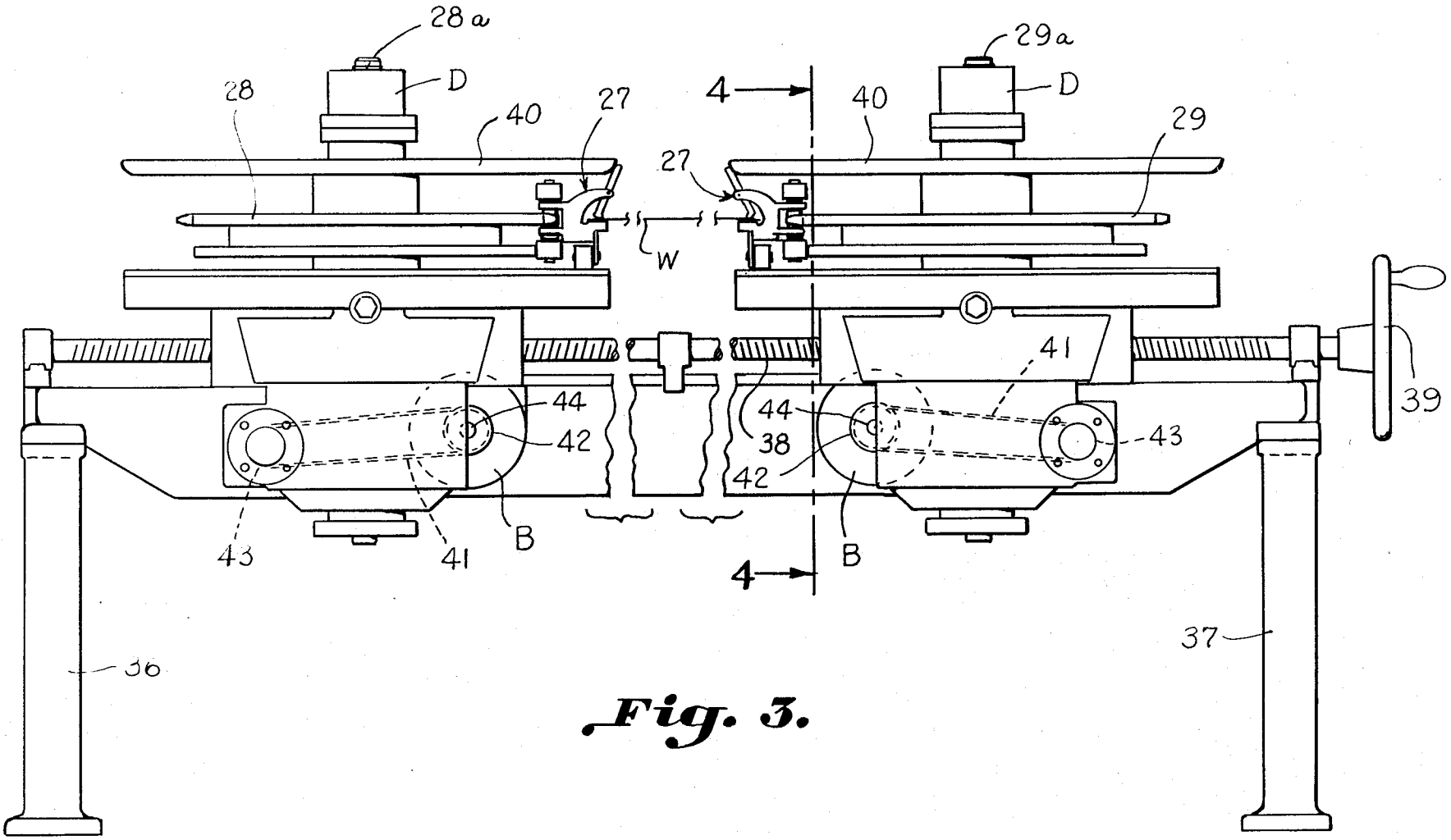
FIG. 3 is a front elevation at the entrance end of the tenter further illustrating an auxiliary drive mechanism constructed in accordance with the present invention.

FIG. 3 illustrates respective side frame members 36 and 37 which support the respective rails and chains. Respective cross-head screws which are provided at spaced points along the tenter frame are illustrated at 38 and are adjustable by means of turning the hand wheel 39 to adjust the spacing between the runs of chain as illustrated in FIG. 3, from the entrance end to the exit or delivery end of the tenter frame. The respective sprockets illustrated at 28 and 29 in FIG. 3, are illustrated as engaging tenter clips broadly designated at 27. The usual camming disks are illustrated at 40 for engaging the respective levers attached to the movable jaws of respective grippers 27 opening them preparatory to engaging the web W as it enters the tenter frame. The auxiliary motors B are illustrated as driving timing belts 41, respectively, through sprockets 42 and 43. The over-running clutches D are illustrated as being carried upon vertical shafts 28*a* and 29*a* upon which the respective sprockets 28 and 29 are carried. The respective motors B drive the respective sprockets 42 from the longitudinal shafts 44.

Figure 4:
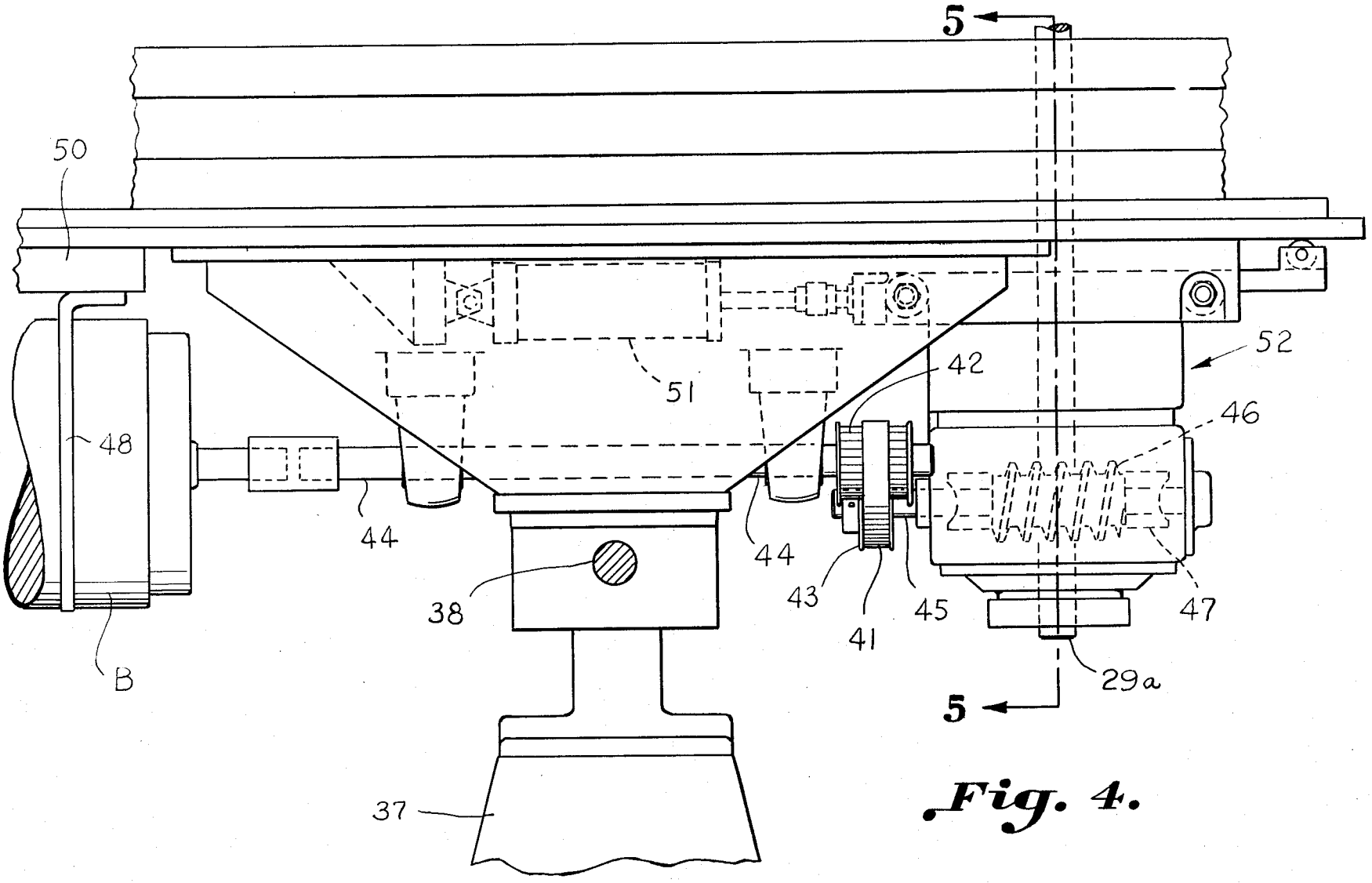
FIG. 4 is a side elevation illustrating the auxiliary drive constructed in accordance with the present invention, taken on the line 4—4 in FIG. 3.

FIG. 4 is a longitudinal side elevation illustrating a motor B with a shaft 44 for driving a respective timing belt 41. The shaft 44 carries a sprocket 42 which, in turn, drives a remote sprocket 43 carried by a shaft 45 which carries a worm 46 for driving the worm gear 47 which, in turn, drives a respective sprocket, the one illustrated being 29 carried by the vertical shaft 29*a* in FIG. 4. The motor B is illustrated as being a three-horse power D.C. motor shielded so that it may be utilized in an environment containing explosive fumes, although any motor of suitable capability may be employed. The motor B is carried by a suitable suspended bracket 48 carried beneath the supporting member 50. It will be observed in FIG. 4 that cylinders 51 may be provided for urging the support mechanism broadly designated at 52, outwardly or to the right hand side in FIG. 4 to properly tension the chain as described herein.

Figure 5:
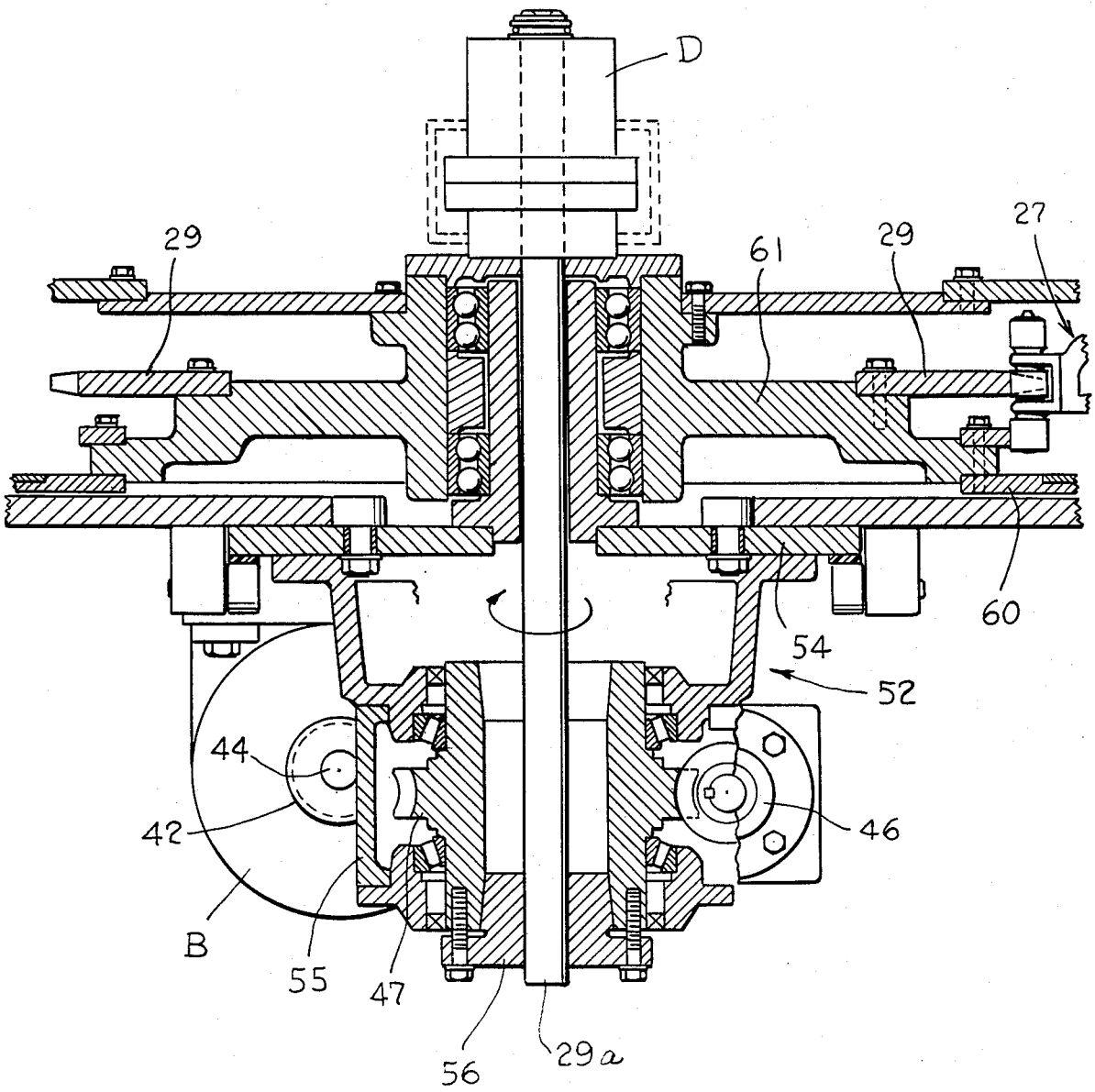
FIG. 5 is a sectional elevation taken on the line 5—5 in FIG. 4 illustrating the clutch mechanism with the auxiliary drive.

Referring more particularly to FIG. 5, a mounting plate 54 is provided for carrying the support mechanism 52. A suitable gear box 55 carries the worm gear 47 driven by the worm 46 in order to turn the respective vertical shaft 29*a* for driving the sprocket 29. The shaft is carried at one end by a tapered lock bushing 56. A support 60 is carried by the hub 61 which also serves as a support for the gear segment 29 carried thereabove and which is illustrated as having teeth engaging the chain carrying the respective tenter frame clips, broadly designated at 27. The shaft 29*a* is normally driven in the direction of the arrow in FIG. 5, however, should the drive system associated with one of the sprockets 28 or 29 fail, the clutch D which is the over-running clutch, would permit the sprockets to idle. A reason, albeit remote, for such a situation to occur may be a reversal of direction of the main drive.

Referring more particularly now to FIG. 6, a section is illustrated transversely of an intermediate portion of a rail 34 which carries a roller clip, broadly designated at 27. The roller clip includes a movable jaw 65 which is operated by the lever arm 66 by a respective camming disk 40 (FIG. 3) at the respective ends of the tenter frame for engaging and disengaging the web W. A bottom roller 67 is carried by a bracket 67*a* which is, in turn, carried by the bifurcated body 68 of the tenter clip. An oppositely directed bifurcated portion of the body 68 carries a bearing for supporting main supporting rollers 69 and 70 upon respective track surfaces 69*a* and 70*a*, which carries the respective rollers 69 and 70. Control linkage 71 is supported by the web W until the edges of the web pass outwardly permitting same to fall, which at the same time permits engagement by the movable jaw 65*a* so as to align the edge portions of the web.

A sliding clip is illustrated in FIG. 6-A wherein the track 80 carried by the respective rail supports the sliding body 81 of the clip on one end while tipping of the clip is prevented by the plate 82. The movable jaw 83 has a camming link 84 which is operated by the respective camming plate 40 to engage and release the web W in the customary fashion.

It is thus seen that a drive and control mechanism and method has been provided for taking out the slack in the chain of a tenter frame so as to avoid chattering and thus permit higher speeds with less wear on the moving parts and the support means provided thereof. The drive mechanism and method hereof facilitates higher speeds and permits specialized applications of roller clips which may be used in hostile environments. The operation of all tenter chains carried by the rail mechanisms of the chains is facilitated due to the fact that there is some division in the drive so that the tension is not concentrated entirely at the engagement of the sprocket and chain at the drive points at the delivery on the main drive end of the tenter frame.

It is desirable that separate motors be utilized in the drive to the separate chains through the sprockets in the auxiliary drive at the entrance end of the tenter. This is because accommodation must be made for the in-and-out movement in order to accommodate webs of somewhat varying widths at the entrance end.

While preferred embodiments of the invention have been described using specific terms, such description is for illustrative purposes only, and it is to be understood that changes and variations may be made without departing from the spirit or scope of the following claims.

What I claim is:

1. In a tenter frame having a pair of vertical clip carrying chains for supporting a web in open width between chains with adjacent horizontal pull side runs and remote return side runs, a sprocket at each end of each chain and rails supporting said clips extending inwardly in opposed relation, a drive comprising:

a power operated means including a mechanical drive connection at a delivery end between adjacent sprockets such that opposed tenter clips carried by respective chains are maintained in registry during a web carrying process;

a separate drive means for each sprocket at an entrance end of said chains;

means generating a signal responsive to conditions prevalent at the delivery end of the tenter frame and indicative of a desired torque in said chains;

means controlling both of said separate drive means in response to said signal to deliver less torque to the respective chains at the entrance end than is delivered thereto at the delivery end and to exert tension sufficient to substantially remove slack in said return side runs while permitting sufficient tension in the pull side runs of said chains; and said means controlling said separate drive means causing sufficient and substantially equal torque to be delivered by each of said separate drive means to each of the respective chains to positively position respective chains avoiding chattering.

2. The method of driving a pair of vertical tenter clip carrying chains for supporting a web in open width between chains with adjacent horizontal pull side runs and remote return side runs, a sprocket at each end of each chain and rails supporting said clips extending inwardly in opposed relation, comprising the steps of:

driving both chains through a mechanical drive connection at a delivery end between adjacent sprockets such that opposed tenter clips carried by respective chains are maintained in registry during a web carrying process;

separately driving each sprocket at an entrance end of said chains through separate drive means;

generating a signal responsive to conditions prevalent at the delivery end of the tenter frame and indicative of a desired torque in said chains;

controlling both of said separate drive means in response to said signal to deliver a torque to the respective chains at the entrance end to exert tension sufficient to substantially remove slack in said return side runs while permitting sufficient tension in the pull side runs of said chains; and controlling said separate drive means causing sufficient and substantially equal torque to be delivered by each of said separate drive means to each of the respective chains to positively position respective chains avoiding chattering.

* * * * *